US005842401A

United States Patent [19]

Hart

[11] Patent Number: 5,842,401

[45] Date of Patent: Dec. 1, 1998

[54] HOLE PUNCH MOUNT FOR SPLIT ROTARY DIE PUNCHES

[75] Inventor: David K. Hart, Rosemont, Pa.

[73] Assignee: David K. Hart Company, Rosemont, Pa.

[21] Appl. No.: 764,953

[22] Filed: Dec. 13, 1996

[51] Int. Cl.[6] ..... B26D 7/26; B26F 1/14

[52] U.S. Cl. ..... 83/698.51; 83/345; 83/669; 83/670; 83/677; 83/678; 83/682; 83/691; 83/698.61

[58] Field of Search ..... 83/669, 678, 677, 83/691, 698.41, 698.61, 698.51, 308, 309, 345, 527, 670, 673–675, 663, 687

[56] References Cited

U.S. PATENT DOCUMENTS

| | | | |
|---|---|---|---|
| 617,012 | 1/1899 | Griffin | 83/670 X |
| 1,466,001 | 8/1923 | Metzner et al. | 83/345 X |
| 2,116,391 | 5/1938 | Gochoel | 83/345 |
| 2,191,148 | 2/1940 | Perbal | 83/675 X |
| 2,239,623 | 4/1941 | Oster | 83/675 X |
| 2,377,130 | 5/1945 | Cohen | 83/675 X |
| 2,666,485 | 1/1954 | Antosh | 83/675 X |
| 3,602,080 | 8/1971 | Sickel | 83/345 X |
| 3,828,632 | 8/1974 | Grano | 83/345 |
| 3,832,925 | 9/1974 | Brandt et al. | 83/345 X |
| 3,985,066 | 10/1976 | Kern | 83/698.51 X |
| 4,434,690 | 3/1984 | Mauer | 83/345 X |
| 4,805,501 | 2/1989 | Nuttin | 83/698.41 X |
| 5,394,779 | 3/1995 | Meeks | 83/698.51 X |

FOREIGN PATENT DOCUMENTS

| | | | |
|---|---|---|---|
| 9105642 | 5/1991 | WIPO | 83/669 |

*Primary Examiner*—Rinaldi I. Rada
*Assistant Examiner*—Charles Goodman
*Attorney, Agent, or Firm*—Paul & Paul

[57] ABSTRACT

A punch assembly is provided for a rotary forms press, for punching holes in a sheet of paper or other material as the material travels between punch and die assemblies. The punch assembly is of the split ring type, and has a hub to be carried on a punch shaft and driven thereby. A split punch ring of multiple segments is provided, for mounting on the hub, with the segments being connected together. The punches are carried by the punch ring. There is a slip fit between the punch ring and the hub to allow movement between the punch ring and hub to accommodate minor repositioning of the punch ring and its punches as the punches enter holes of dies with which they will engage, with the slip fit allowing either rotary repositioning or axial repositioning. Clearance is provided to an enable a limited amount of axial repositioning.

6 Claims, 4 Drawing Sheets

HOLE PUNCH MOUNT FOR SPLIT ROTARY DIE PUNCHES

BACKGROUND OF THE INVENTION

The present invention is directed to punch presses, more specifically to rotary die punches of the split type, for mounting on shafts of web-fed rotary form presses.

Typically, a split punch ring is mounted on a shaft, with the generally two segments being fastened together across the split line, around a shaft, to be driven by the shaft, generally by means of a key drive. Traditionally, the die corresponding to the punch, is likewise split, also generally into two 180° segments, and is likewise key-mounted on a rotating shaft disposed below the punch shaft.

Generally, there are two such sets of split rotary punch and die complements, spaced apart on the shafts. The two shafts are generally gear-driven together, with the shafts generally being bearing mounted at their ends.

Also, traditionally, the dies have hardened die openings and the punches are mounted in rings and are constructed of replaceable, relatively soft steel, relative to the hardness of the dies, into which the punches will punch paper cut-outs together with the dies as the punches penetrate the die openings. The paper that is being punched is usually free to pass through the dies to provide escape routes for the paper punched out of the forms. Conventionally, the punch and die rings are usually split so that they may readily be installed and removed from the press shafts, without having to demount the shafts from their bushings.

While the system described above has been generally workable, punch life is relatively short, and while there are generally provided a means for adjusting the punches during their lives, generally by means of rings that allow radial inward or outward adjustment of the positions of the punches, it has been found that the relatively soft punches do not very well survive re-positioning the rings.

More recently, there has been developed a system of hardened punches disposed in a peripheral ring, that, in turn, is mounted on a punch hub that is carried on the punch shaft, in the form of a pair of complete circular outer and inner bearing races with ball bearings or roller bearings disposed between the races. Because of the ball or roller bearings, the rings are not, and cannot, be split rings. This arrangement has been found to be disadvantageous, in that, because the rings are not and cannot be split, when the punches are to be removed to replace the hardened steel punches, it is necessary to remove the press punch shafts, requiring a rather major disassembly, and loss of useable press time. In the arrangement described immediately above, while the die shaft remains timed to the operation of the press, the outer race of the punch shaft is an idler; not gear driven or in any other manner driven directly from either the punch shaft or die shaft, but is essentially driven by contact of the punches into the die holes, as paper is punched between the cylindrical punch ring and die ring. However, the above-mentioned disadvantage of necessary disassembly of the punch rings from the shaft when the punch rings need replacement, by removing the shaft from its journal or bearing mounts at ends of the press, creates undesirable down time in the operation of the press.

SUMMARY OF THE INVENTION

The present invention is directed toward providing an improved punch mount for split rotary die punches, wherein the punches are carried in split punch rings, and preferably with the dies likewise carried in split die rings, and with the punch shaft and die shaft driven together, as by means of gears or the like, in a conventional manner, but whereby there is an outer punch ring mounted on a hub that, in turn, is fixedly carried by the punch shaft, but with there being a slip fit between the outer punch ring and the shaft-mounted hub, to enable a limited amount of relative rotational and axial movement between the punch ring and the hub, for minor automatic adjustments in position of the outer punch ring relative to the die openings, as harden punches find their precise locations in die holes in the driven die ring.

Accordingly, it is a primary object of this invention to provide a split shaft-mounted rotary punch ring mounted in slip fit engagement over a split punch hub that, in turn is adapted to be shaft-driven from a press punch shaft.

It is another object of this invention, to provide combination punch and die rings, each of the split ring type, for mounting on driven punch and die shafts for rotary presses, wherein there is a slip fit between the ring that carries the punches and a hub on which the ring is mounted, for minor rotary and axial adjustments in position of the punch ring as the punches engage within die holes.

Other objects and advantages of the present invention will be readily apparent upon a reading of the following brief descriptions of the drawing figures, detailed descriptions of the preferred embodiments and the appended claims.

DETAILED DESCRIPTIONS OF THE PREFERRED EMBODIMENTS

Figure 1:
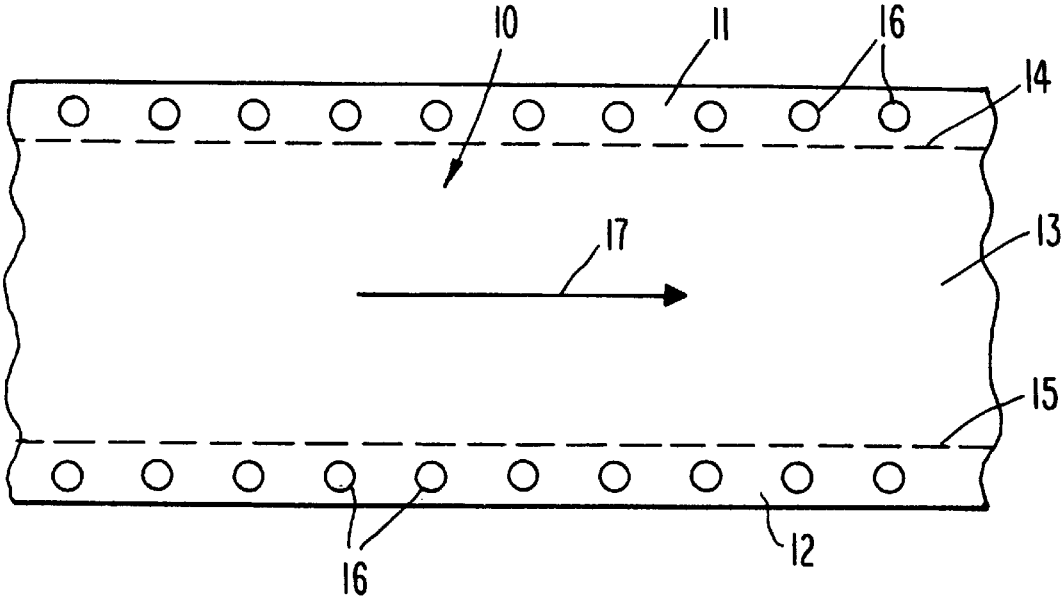
FIG. 1 is a fragmentary view of a sheet of paper or the like of the type generally punched on web-fed rotary form presses, with marginal holes as shown, in removable tear strips on opposite sides of the paper sheet, which removable tear strips are adapted to be removed by being torn along the score lines.

Referring now to the drawings in detail, reference is first made to FIG. 1, wherein there is fragmentally illustrated a sheet 10 of paper having margins 11 and 12 on opposite sides thereof, connected to the central portion 13 of the sheet by perforated lines 14 and 15, and with the sheet 10 having a plurality of generally equidistantly spaced-apart circular perforations 16 punched therein by means of the rotary punch and die arrangement discussed hereinafter. It will be understood that the sheet 10 is fed through the apparatus of this invention in the direction of the longitudinally disposed arrow 17.

Figure 2:
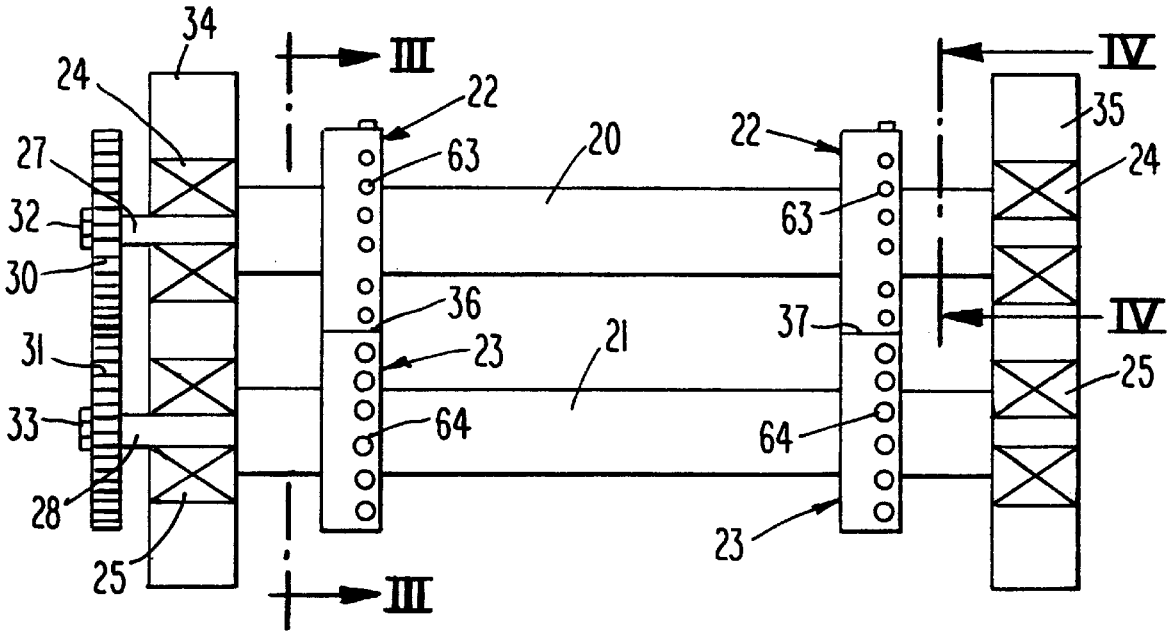
FIG. 2 is schematic vertical view, looking generally upstream of a web-fed rotary forms press, in the direction opposite the flow of paper through the machine, and wherein upper and lower shafts are shown geared together, for driving the punch and die shafts together.

With reference now to FIG. 2, it will be seen that upper and lower shafts 20 and 21, respectively, mount punch ring assemblies 22 and die ring assemblies 23 respectively, at each end of the rotary press shafts 20, 21. Opposite ends of the shafts 20, 21 are journaled in suitable cylindrical roller bearings or alternatively bushings 24, 25, for free rotation therein. The shafts 20, 21 have, as shown at the left side of FIG. 2, shaft drive extensions 27, 28, which in turn have mating spur gears 30, 31 disposed respectively thereon suitably keyed thereto (not shown) and affixed thereto by suitable end bolts or other securement means 32, 33.

It will be noted that the shaft bearings 24, 25 are mounted in suitable vertically disposed machine side frames 34, 35.

The punch and die assemblies 22, 23 therefore define a plane at their zones of contact 36, 37, through which the sheet 10 of paper (or suitable other material, such as plastic film or the like), as shown in FIG. 1, may pass, in the plane established at zones 36, 37, coming out of the plane of the paper as seen in FIG. 2.

The punch assemblies 22 and die assemblies 23, respectively have punches 63 and die holes 64 disposed generally equidistantly about the peripheries of assemblies 22, 23, as shown in FIG. 2.

Figure 3:
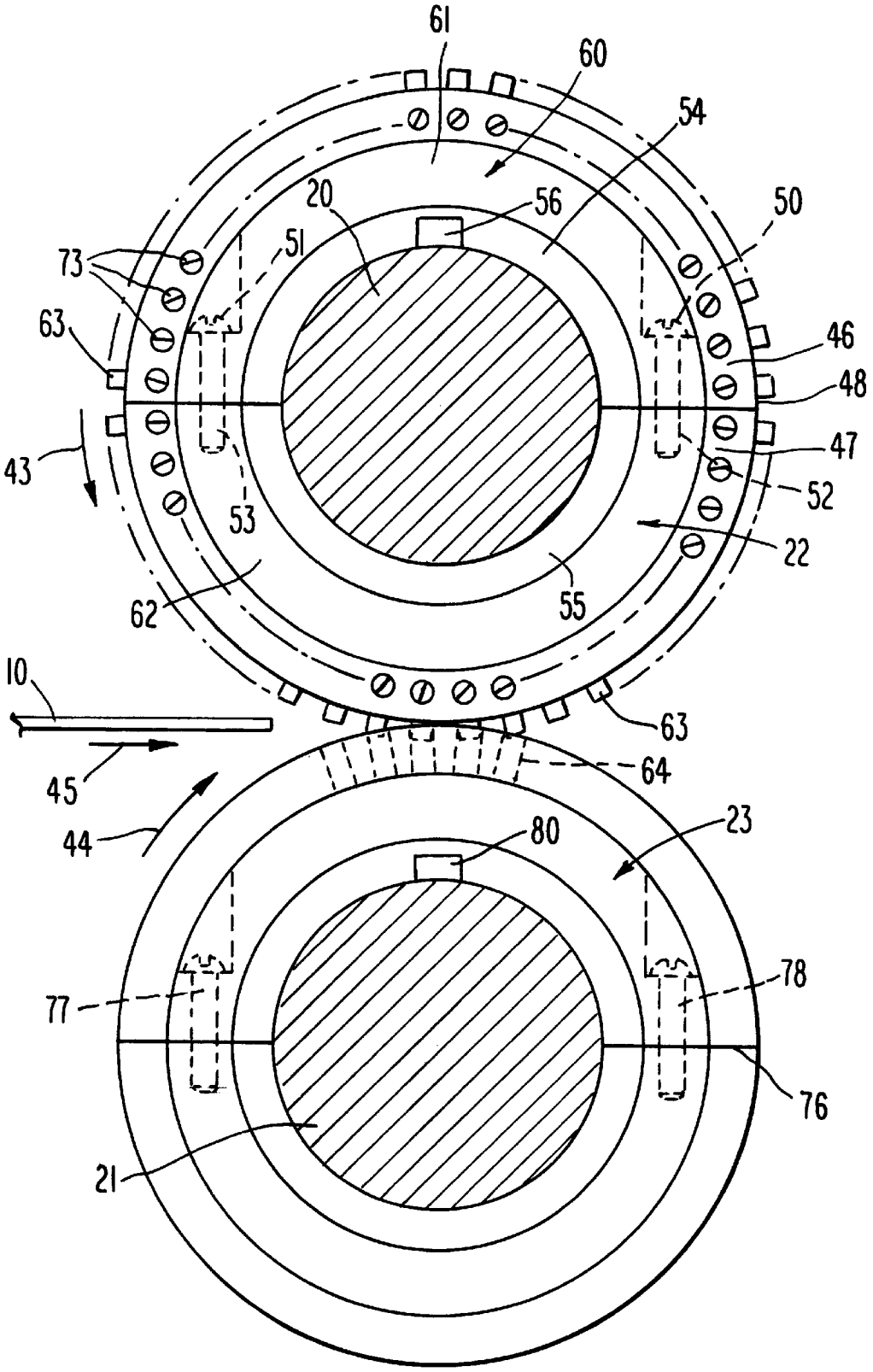
FIG. 3 is a vertical sectional view, taken generally along the line III—III of FIG. 2, and wherein the inter-engagement of punches carried on the upper assembly is shown, caused to take place in the die holes on a die ring carried by the lower assembly, with both upper and lower assemblies being shown as being of the split ring type, each key-driven from their respective shafts.

Referring now to FIG. 3 it will be seen that the punch assembly 22 is shown carried by the shaft 20, for rotation therewith in the direction of the arrow 43, just as the die assembly 23 is mounted on the shaft 21 for rotation therewith, in the direction of the arrow 44, as a sheet of paper 10 travels horizontally between the punch and die assemblies in the direction of paper flow, as shown by the arrow 45 in FIG. 3.

Figure 4:
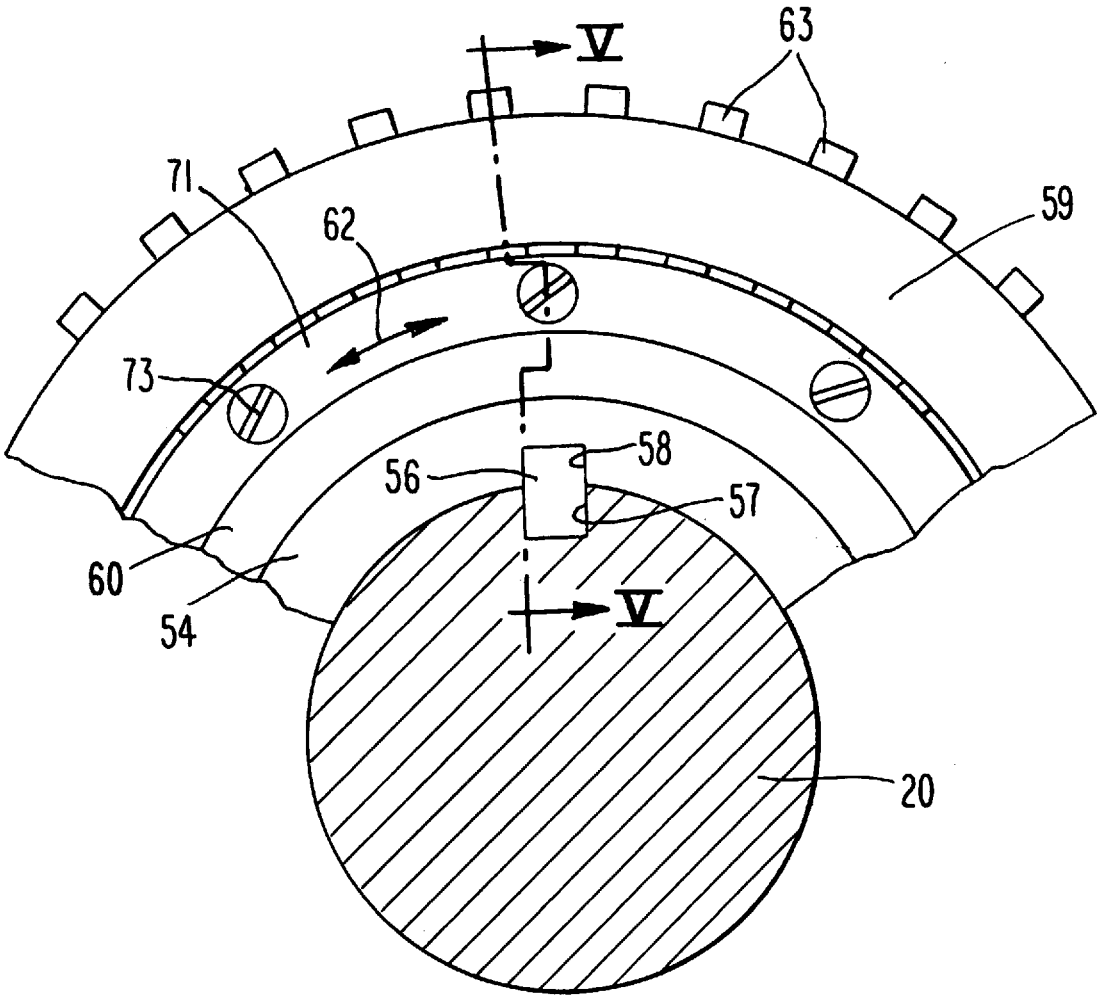
FIG. 4 is an enlarged fragmentary transverse sectional view, taken through the punch, and showing the penetration setting ring and its fasteners, for adjusting the position of the punches within the punch mount ring, with the illustration of FIG. 4 also being taken along the line IV—IV of FIG. 5.

The punch 22 is split into upper and lower segments comprising assemblies 46, 47 along the parting line 48, into two 180° sections, fastened together on opposite sides of the shaft 20 by suitable screws or other threaded fasteners 50, 51 engaging in screw threads 52, 53 as shown in dotted line illustration in FIG. 3. It will thus be seen that the upper and lower assemblies 46, 47 are clamped together on shaft 20. A split hub 54, 55 is shown, also carried by the assemblies 46, 47, against the shaft 20, with the hub segments 54, 55, generally being constructed of bronze or other suitable material, with the hub segment 54 being keyed to the shaft 20 by means of a suitable key 56 disposed in a keyway 57 in the shaft 20, as illustrated in FIG. 4, and also disposed in a slot 58 of the hub segment 54, for driving the hub through hub segment 54, as the shaft 20 rotates. A punch outer ring 60 is also comprised of ring segments 61, 62, which come together along the parting line 48, with a slip fit against the bronze hub 54 along the cylindrical surface 69', to allow the outer ring 60 to have a small amount of movement, either clockwise or counterclockwise, in the direction of the double-headed arrow 62, as shown in FIG. 4, to allow for correct placement of punches 63 in die holes 64 (shown in phantom in FIG. 3—it will be understood that the die holes 64 are substantially evenly spaced apart all around the periphery of the die assembly 23, although only five such die holes are shown in phantom in FIG. 3). Thus, as a given hardened, preferably steel punch 63 approaches a die hole 64 in die assembly 23, for entry thereinto, as it is about to punch a hole 16 in a paper sheet 10 being delivered between the punch and die assemblies, any imperfection in placement or alinement of the punches 63 relative to the die holes 64 may be corrected by allowing a small degree of rotational slippage between the ring 60 and the hub 54.

Figure 5:
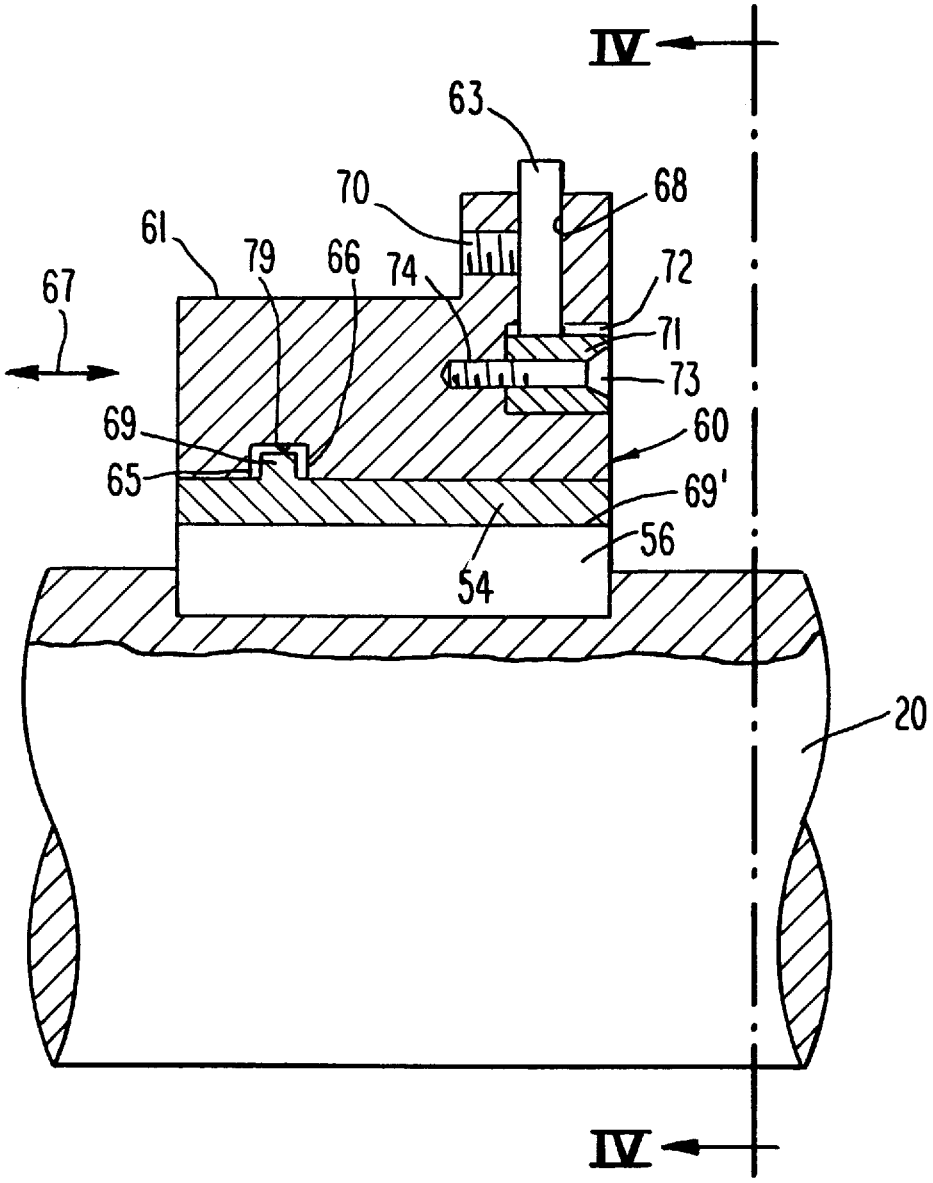
FIG. 5 is a vertical sectional view, taken generally along the line V—V of FIG. 4, and wherein the slip fit of the punch ring relative to its shaft-mounted and keyed hub is illustrated, as well as the mounting for the penetration setting ring of FIG. 4.

Similarly, it will be seen that there is lateral clearance at 65 and 66 on opposite sides of the annular axial-motion-limiting protrusion 69 in the annular slot 79 in which it is disposed, between the ring 60 and hub 54, in order to allow a minor amount of movement for the same type of adjustable positioning of punches 63 entering die hole 64, with such movement of the ring 60 being axial, either leftward or rightward as viewed in FIG. 5, in the direction of the double headed arrow 67. Generally the punches 63 are mounted in suitable punch holes 68 in the ring 60, as shown in FIG. 5, being fixedly positioned therein by means of set screws 70.

It will be noted, particularly with reference to FIGS. 4 and 5, that a penetration setting ring 71 is provided in each half of the die assembly, above and below the split line 48, carried by the ring segments 61, 62, in annular openings 72, secured thereto by suitable fasteners 73 threadedly engaged with the ring segments 61, 62, as at 74. The purpose of the penetration setting ring 71 is to permit adjustment of the height of the punches 63 (or radial placement in punch openings 68), and to this end, the rings 71 may be provided with various thickness, all of which will fit within annulus 72, for allowing different degrees of protrusion of the punches 63 out of the ring 60, as shown in FIGS. 4 and 5.

The penetration setting rings 71 also permit the use of re-sharpened punches 63, in that each sharpening of punches 63 will reduce the size of the punch, such that a perhaps larger exterior diameter penetration setting ring 71 would be required after re-sharpening of punches 63.

With reference to FIG. 3, it will be seen that the die assembly 23 is likewise comprised of upper and lower parts, brought together along a parting line 76, connected by fasteners 77, 78 in much the same manner as has been described above with respect to the punch assembly. The die assembly 23 is likewise driven via a suitable key 80 from the shaft 21, and is provided about its periphery with a plurality of equidistantly spaced hardened die opening surfaces 64, for receiving the punches 63 therein, such that holes 16 may be punched into the paper 10 as it passes therebetween. Generally, the die assemblies 23 are constructed such that the lower ends of the die holes 64 enable punched-out portions of the paper, that occur from making the holes 16, to pass radially inwardly therethrough (not shown), to be discarded.

It will be apparent from the foregoing that various modifications may be made in the details of construction, as well as in the use and operation of the device of this invention, all within the spirit and scope of the invention as defined in the appended claims.

What is claimed is:

1. A punch assembly for a rotary forms press, for punching a plurality of spaced apart holes in a sheet of material as the sheet is conveyed between said punch assembly and a die assembly, the punch assembly comprising a hub fixedly mounted on a punch shaft for driven rotation therewith; a split punch ring of multiple segments having an outer periphery and mounted on the hub; fastening means connecting the multiple segments of the split punch ring about the hub; a plurality of relatively hard punches generally equidistantly disposed about the outer periphery of the punch ring and protruding radially therefrom a certain amount; means securing the punches in position on the punch ring; with the split punch ring having an inner generally cylindrical surface and with the hub having an outer generally cylindrical surface; with said cylindrical surfaces being in slip fit engagement, said slip fit engagement allowing relative rotational movement between said punch ring and hub, for accommodating minor rotary repositioning of the punch ring and punches carried thereby as punches enter holes of said die assembly with which they will engage to cut holes in the sheet of material wherein there are axial-motion-limiting means protruding radially between said punch ring and said hub for limiting axial movement of said punch ring relative to the hub, and wherein clearance is provided, associated with said axial-motion-limiting means, for accommodating minor axial repositioning of the punch ring and punches carried thereby as punches enter the holes of said die assembly with which they will engage to cut holes in the sheet of material.

2. The assembly of claim 1, wherein said axial-motion-limiting means comprises a cylindrical protrusion carried by said hub, in axial slip fit engagement with a cylindrical annulus carried in said punch ring.

3. The assembly according to any one of claims 1 or 2, wherein said hub is a split hub of multiple segments, mounted on the shaft and connected thereto by a plurality of fasteners.

4. The assembly of any of claims 1 or 2, including a penetration setting ring carried by the punch ring for adjustably controlling the amount of radial projection of punches beyond the periphery of the punch ring, and setting ring fastening means for fastening the setting ring into an annular, axially-opening groove of the punch ring.

5. The assembly of claim 4, wherein said setting ring is a split ring comprised of multiple segments.

6. A punch and die assembly for a rotary forms press, for punching a plurality of spaced apart holes in a sheet of material as the sheet is conveyed between a punch sub-assembly and a die ring sub-assembly carried by the punch and die assembly, comprising:

(a) the punch sub-assembly comprising a hub, fixedly mounted on a punch shaft for driven rotation therewith and including;

(i) a split punch ring of multiple segments having an outer periphery mounted on the hub; fastening means connecting the multiple segments of the split punch ring about the hub; a plurality of relatively hard punches generally equidistantly disposed about the outer periphery of the punch ring and protruding therefrom; means securing the punches in position on the punch ring; with the split punch ring having an inner generally cylindrical surface and with the hub having an outer generally cylindrical surface; with said cylindrical surfaces being in slip fit engagement, said slip fit engagement allowing relative rotational movement between said punch ring and hub for accommodating minor rotary repositioning of the punch ring and punches carried thereby to cut holes in the sheet of material; and (b) the die ring sub-assembly having an outer periphery, the die ring sub-assembly including;

(ii) multiple die segments that together comprise a cylindrical member, mounted on a die shaft; fastening means connecting the multiple segments of the die ring sub-assembly as a split die ring about the die shaft; and the die ring sub-assembly having a plurality of hard die openings generally equidistantly disposed about the outer periphery of the die ring sub-assembly wherein there are axial-motion-limiting means protruding radially between said punch ring and said hub for limiting axial movement of said punch ring relative to the hub, and wherein clearance is provided, associated with said axial-motion-limiting means, for accommodating minor axial repositioning of the punch ring and punches carried thereby as punches enter the holes of said die ring sub-assembly with which they will engage to cut holes in the sheet of material.

* * * * *